United States Patent [19]

Ferrarell

[11] 4,132,013

[45] Jan. 2, 1979

[54] FILM DRYER

[75] Inventor: Michael J. Ferrarell, Chicago, Ill.

[73] Assignee: Buckingham Graphics, Inc., Chicago, Ill.

[21] Appl. No.: 757,636

[22] Filed: Feb. 8, 1977

Related U.S. Application Data

[63] Continuation-in-part of Ser. No. 652,982, Jan. 28, 1976, abandoned.

[51] Int. Cl.[2] ..... F26B 13/00

[52] U.S. Cl. ..... 34/160; 34/155; 34/70

[58] Field of Search ..... 34/66, 67, 70, 71, 95, 34/155, 156, 158, 160, 161, 162, 163, 233

[56] References Cited

U.S. PATENT DOCUMENTS

| | | | |
|---|---|---|---|
| 2,639,517 | 5/1953 | Sardeson et al. | 34/162 |
| 2,640,277 | 6/1953 | Dungler | 34/162 |
| 3,660,911 | 5/1972 | Buckingham | 34/160 |
| 3,834,040 | 9/1974 | Russell et al. | 34/160 |

FOREIGN PATENT DOCUMENTS

| | | | |
|---|---|---|---|
| 2120056 | 11/1971 | Fed. Rep. of Germany | 34/155 |
| 2351503 | 4/1975 | Fed. Rep. of Germany | 34/155 |

*Primary Examiner*—Kenneth W. Sprague
*Assistant Examiner*—James C. Yeung
*Attorney, Agent, or Firm*—Olson, Trexler, Wolters, Bushnell & Fosse

[57] ABSTRACT

A film dryer is provided primarily for use in the graphic arts in which relatively large sheets of film must be processed and dried. A part of input rollers is of sufficiently hard rubber as to squeegee off most of the surface moisture which drops into a drip pan where it may be emptied. Subsequent guide rollers are of short axial extent and spaced apart. Air jets are slightly warmed and blow generally toward one another and against the surface of the film, and back toward the entrance, whereby to carry moisture back into the area of the drip tray for collection. O-rings or other resilient guides are positioned over suitable supporting structure to prevent the film from wrapping up about the various rollers.

5 Claims, 9 Drawing Figures

10a
14a
22a
26a
8
164
90a
100a
160
160
164
80a
60a
64a
92
72a
30a
88a
32a
36

170
164
170
164
160
160
62
62

100a
164
168
166
176
174
160

146a
148a
178
9
174
166
168
104
176
170
172
9
160
164
100a

FILM DRYER

This application is a continuation in part of my copending application Ser. No. 652,982 filed Jan. 28, 1976, abandoned.

BACKGROUND OF THE INVENTION

Relatively large sheet films, for example 18 inches by 24 inches, are used in the graphic arts for making photographic negatives. Generally such negatives must be available shortly after exposure for making of prints and the like therefrom. Thus, it is common practice to utilize film dryers for drying such film. It is recognized that such film should not be subjected to very high heat as high temperatures may cause damage to the film base, or to the emulsion thereon. Therefore, it is common practice to squeegee off a portion of the moisture and to blow the rest of the moisture away at a temperature elevated only slightly above room temperature.

One such film dryer that has enjoyed some measure of commercial success is that shown in Edgington U.S. Pat. No. 3,557,469. This dryer has had certain drawbacks as discovered during operation in the field. This apparatus has been unduly complicated in structure, too large and heavy, requiring too many parts, and being too expensive. Furthermore, provision is made to limit escape of air through the inlet opening, and this concomitantly limits the escape of moisture through the inlet opening. Indeed, no specific provision is made in the apparatus in question for disposing of moisture removed from the film, and consequently large amounts of moisture collect in the machine. The squeegee rollers are relatively soft, thus requiring two steps, while the blowers are aimed directly toward one another and at the film plane. Consequently, moisture collects throughout the machine. The moisture is not pure water, but contains a substantial amount of acid from the final fixing and hardening process in photographic development. As a result, the machine housing soon rusts and corrodes, often leaving gaping holes, and ultimately leaving the machine quite useless even though moving, mechanical parts, usually the life limiting portions of any machine, remain serviceable. Furthermore, the machine under consideration has utilized plastic clips for preventing wind up of film. These plastic clips, exposed to constant moving air at somewhat elevated temperature are prone to lose their plasticity and to break. Such clips are of special manufacture, and are not easily obtained or installed for replacement.

OBJECTS OF THE PRESENT INVENTION

It is an object of the present invention to provide a film dryer primarily for use in the graphic arts which avoids the deficiencies of the prior art, and in particular which is smaller, requires less parts, and is less expensive to fabricate and to maintain.

In particular, it is an object of the present invention to provide such a film dryer which has one area of maximum moisture removal with a drip tray provided for catching the moisture so removed.

If further is an object of this invention to provide such a graphic arts film dryer having wide areas of egress for moisture laden air, whereby to prevent collection of moisture within the housing of the machine.

It is further an object of the present invention to provide improved means for preventing rolling up of film about rollers, i.e., stripping means, which are long lived, readily available in commerce, and readily installed initially or for replacement.

DRAWING DESCRIPTION

The invention will be understood with reference to the accompanying drawings wherein.

DETAILED DISCLOSURE OF THE ILLUSTRATIVE EMBODIMENTS

Figure 1:
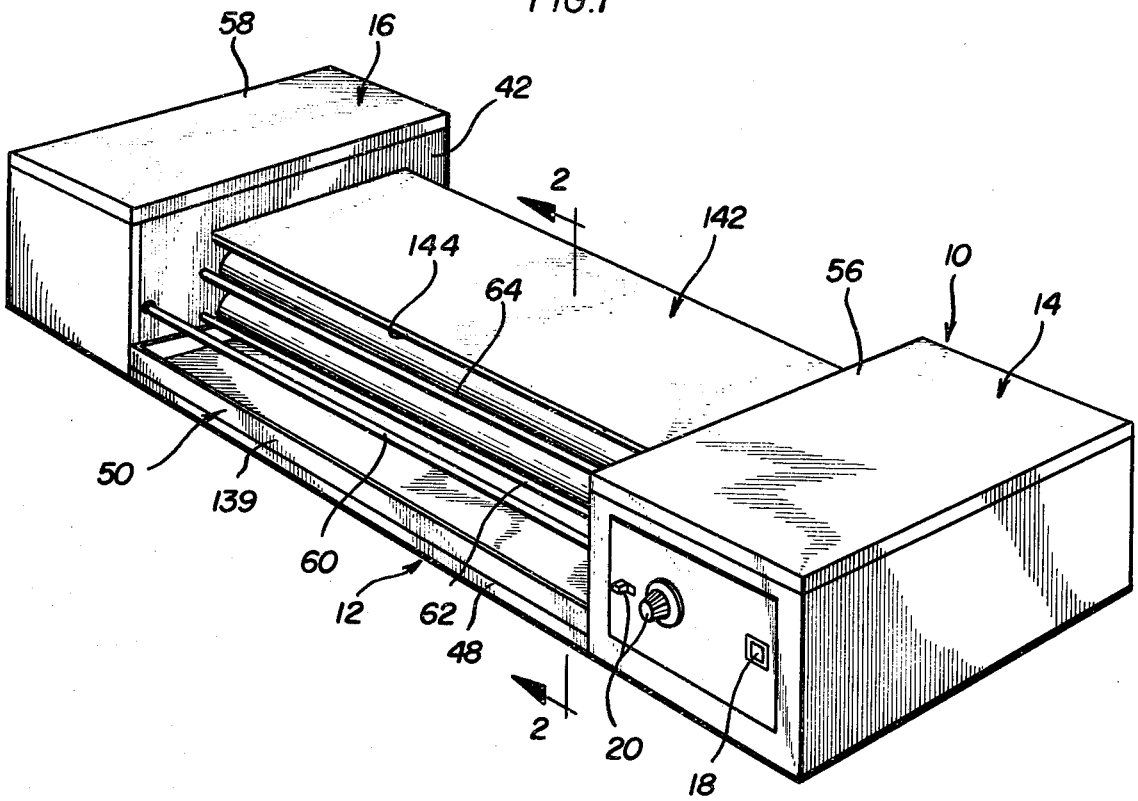
FIG. 1 is a perspective view of a film dryer constructed in accordance with the present invention.

One form of the invention is shown in FIGS. 1-4.

A film dryer 10 constructed in accordance with the present invention is provided with a housing 12 having a right end section 14 and a left end section 16. The right end section is of rectangular box-like configuration and is provided on the front with a pilot light 18 and electrical controls 20. A motor 22 and gear reducer mechanism 24 of known construction is mounted within the right end housing section 14 and is provided with an output shaft fitting 26 rotating at predetermined speed.

The left end housing section 16 is provided with a front-to-rear divider wall or baffle 28 on which is mounted a motor 30 and blower unit 32 of well-known configuration. A double motor and blower set, i.e., two motors and two blowers, is used in a longer machine. The left end wall 34 of the left end housing section is provided with inlet air louvers 36 for admission of air to the blower unit 32. Outlet air from the blower unit, as indicated by the arrows 38 passes through a central opening in the wall or baffle 28 into a chamber or plenum 40 at the right side of the left end housing section. The left end housing section further is provided with an inner or right end wall 42, while the right end housing section 14 is provided with a similar wall 44 and also a partition wall 46 spaced slightly therefrom.

A common floor or bottom wall 48 extends beneath the entire machine, including the end housing portions, and a central section 50. The front and rear edges of the floor 48 are rolled under in more or less channel shape at 52 for rigidity. From approximately one third away from the front edge the floor 48 is provided with a raised shelf 54 extending to the back edge. The right and left end housing sections 14 and 16 are respectively provided with removable tops or covers 56 and 58 held in place by screws or other suitable structure.

A front rod 60 extends between the end plates 42 and 44 somewhat less than half way from top to bottom of the machine. A second rod 62 parallel to the rod 60 is on the same level with the rod 60 and spaced rearwardly thereof. A third rod 64 is spaced directly above the rod 62.

Rearwardly of the rods 62 and 64 and parallel thereto and respectively on the same levels are a pair of rotating shafts 66 and 68 journaled in the end walls 42 and 44, preferably by means of nylon or the like bearings inserted in the walls. Relatively hard, but yet somewhat resilient rollers 70 and 72 are fixed on the shafts 66 and 68, respectively, and are in pressure engagement with one another. These rollers turn in the directions of the arrows 74 and 76 in FIG. 2 and serve as squeegee rollers.

Spaced inwardly of the shafts 66 and 68, and respectively on a level therewith, are hollow tubes 78 and 80. These tubes are supported by the end walls 42 and 44, extending through the end walls 42 and receiving air under pressure, and warmed slightly by the motor 30, from the plenum 40, as indicated by the arrows 82 in FIG. 3. The right ends of the tubes are closed, and the lower tube 78 is provided with a stub-shaft 84 extending through the wall 44.

Figures 3, 4:
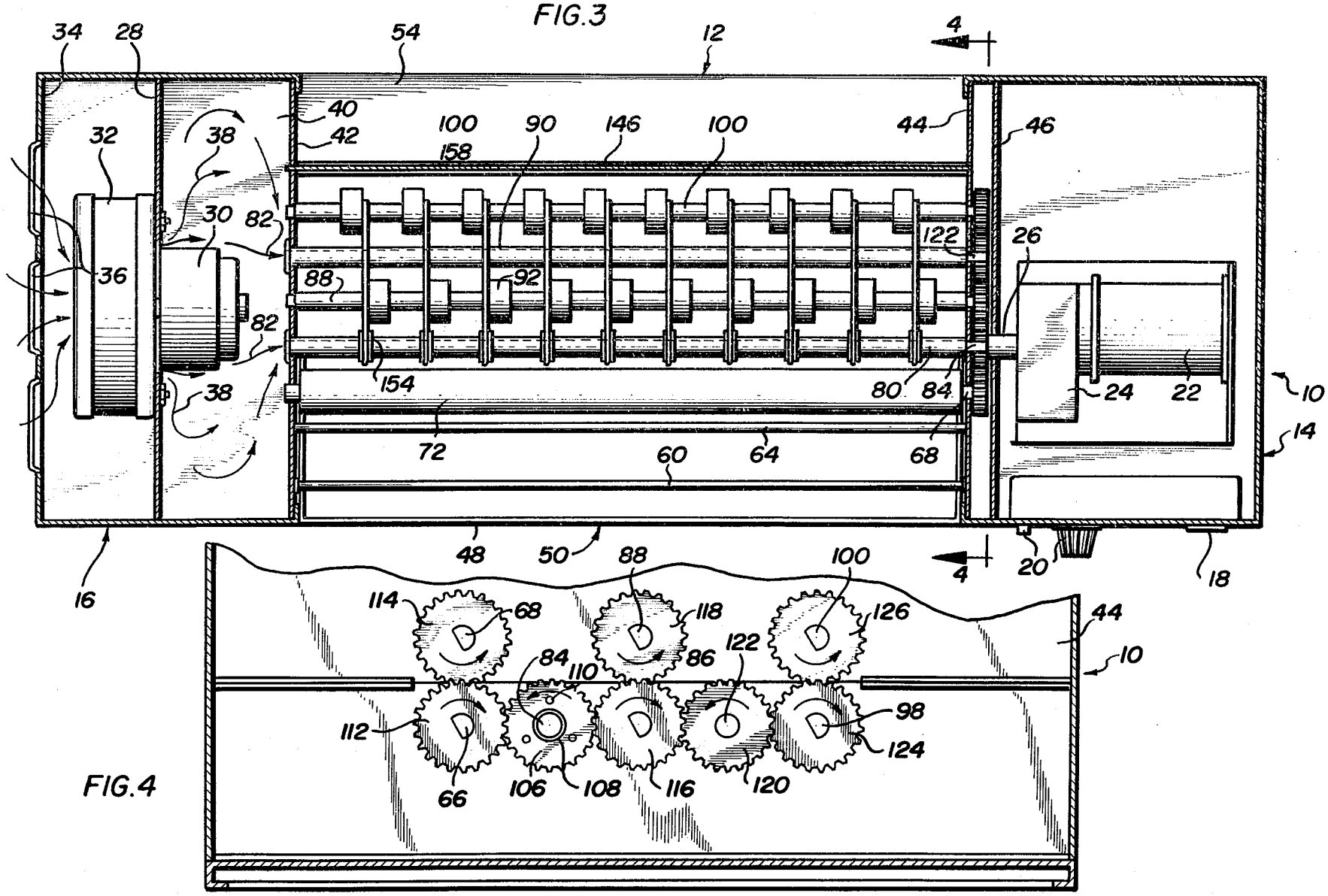
FIG. 3 is a horizontal sectional view as taken substantially along the line 3—3 of FIG. 2.
FIG. 4 is a fragmentary view partially in vertical section as taken substantially along the line 4—4 in FIG. 3.

Continuing inwardly or rearwardly of the machine, and on the same levels as before, there are provided two rotatable shafts 86 and 88 journaled in the end walls 42 and 44 in a manner similar to the shafts 66 and 68. These shafts are respectively provided with axially short rollers 90 and 92, which as best may be seen in FIG. 3, are of limited axial extent, and are spaced apart axially by a distance greater than their respective axial lengths. The rollers 90 and 92 comprise guide rollers, and are of relatively soft rubber as compared with the squeegee rollers 70 and 72, as they are intended for guidance only, and not for squeezing of moisture from the film.

Further toward the rear of the apparatus, and again on the same respective levels, are another pair of air distribution tubes 94 and 96, similar in nature and disposition to the tubes 78 and 80 heretofore mentioned. Continuing toward the rear of the machine, and on the same respective levels as heretofore, are two more rotating shafts 98 and 100 mounted in the same manner as the shafts 86 and 88, and also carrying axially short, and axially spaced rollers 102 and 104, of the same general softness as the rollers 90 and 92. All of the rollers 90, 92, 102 and 104 are made of foam rubber having closed cells and a continuous skin. They are conveniently sections cut from foam material used for pipe insulation. The squeegee rollers 70, 72 are of solid (but resilient) rubber. None of the rollers can absorb or retain any moisture. The roller pairs 90 and 92, and 102 and 104 are off set axially, as best seen in FIG. 3, so that the left faces of the front rollers, 90 and 92, are spaced slightly to the right of the corresponding right faces of the rollers 102, 104.

Turning to FIG. 4, an aluminum gear 106 is journaled on the stub shaft 84, preferably having a brass bearing 108 inserted in the gear. The gear is provided with three arcuately spaced axial aperatures 110 for receiving pins extending from the drive fitting 26 on the output shaft of the gear reducer unit 24.

A nylon gear 112 is rotationally fixed to the end of the shaft 66, as by having a D-shape, the nylon gear 112 meshing with and being driven by the aluminum gear 106. A similar nylon gear 114 meshes with the gear 112, and is similarly fixed on the end of the shaft 68, whereby the gears are drived and consequently drive their respective shafts.

A nylon gear 116 is likewise fixed on the end of the shaft 86 and meshes with and is driven by the aluminum gear 106. The gear 116 meshes with another nylon gear 118 fixed on the end of the shaft 88, whereby the gear 118 is drived from the gear 116, and turns the shaft 88. An idler nylon gear 120 is rotatable on stub shaft 122 extending from the air distribution tube 90, and meshes with and is driven by the gear 116. The idler gear 120 in turn meshes with and drives a nylon gear 124 fixed on the end of the shaft 98 in the same manner as heretofore. The gear 124 meshes and drives yet another nylon gear 126 fixed on the end of the shaft 100 as heretofore. All of the gears turn in the direction of the arrows noted thereon in FIG. 4. Film 128 is inserted from the front of the machine, i.e., from left to right in FIG. 2, passing above the rods 60 and 62, and beneath the rod 64, and hence between the squeegee rollers 70 and 72. The film then passes on between the pairs of rollers 90, 92, and 102, 104 and out the back of the machine.

The air distribution tube 78 is provided along its top left edge with spaced openings 130, while the air distribution tube 94 is provided with similar spaced openings 132. As to the upper air distribution tubes, the tube 80 is provided with spaced air openings 134 in the lower left quadrant thereof, while air distribution openings 138 are similarly diposed in the air distribution tube 96. Thus, air from the distribution tubes blows against the surfaces of the film 128, and back toward the squeegee rollers 70 and 72, and hence the entrance of the drying area. A large percentage of moisture adhering to the film is squeegeed off by the rollers 70 and 72, and drips into a stainless steel drip tray 139 resting on the floor 48, and having a lip 140 extending over the shelf 54. The drip tray fits between the end walls 42 and 44, not quite snuggly, so that it is readily inserted and removed from the machine. Any surface moisture that is not removed by the squeegee rollers 70 and 72 is blown back toward the squeegee rollers by air emanating from the respective openings in the air distribution tubes, whereby such moisture also drips down into the tray 139, and does not collect anywhere in the machine. As to moisture that has been absorbed by the surfaces of the film, this is removed by the air jets in the form of humid air, which exits readily from the machine, since the drying area is only partially enclosed.

Figure 2:
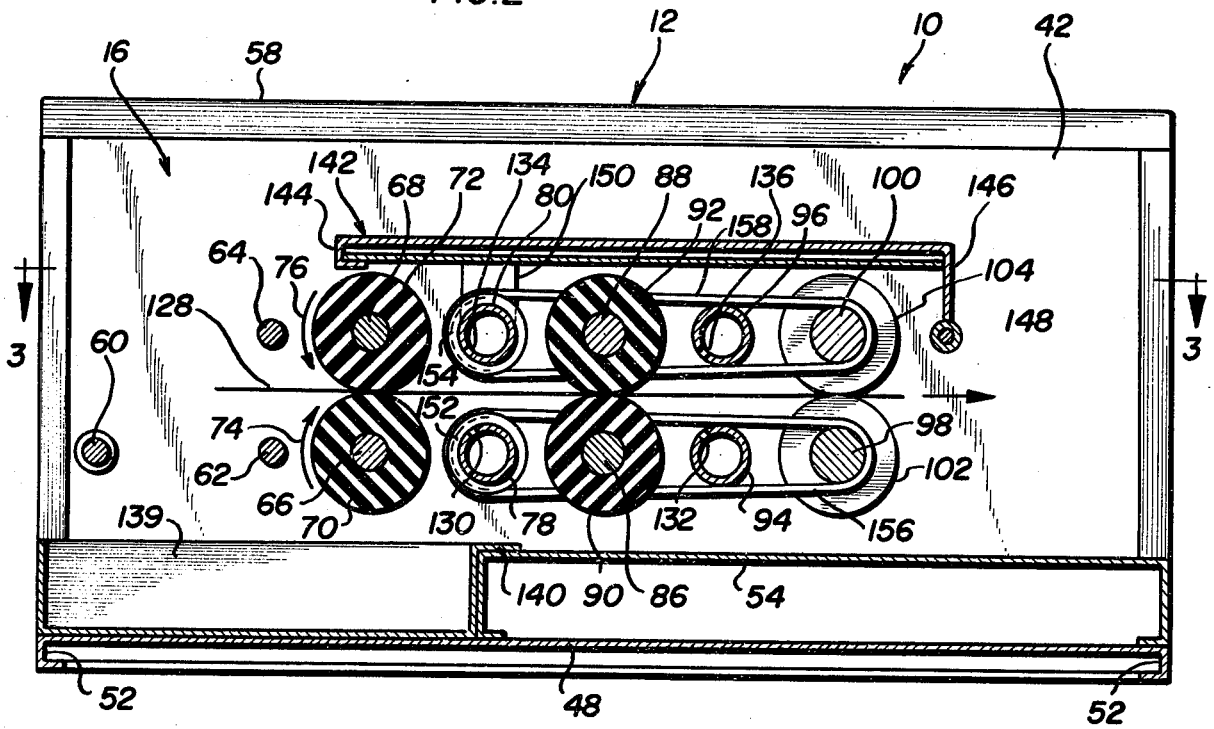
FIG. 2 is a cross-sectional view there-through as taken substantially along the line 2—2 of FIG. 1.

Specifically, a lid or cover 142 has a front edge 144 which extends just slightly to the left or forward of the center line of the squeegee rollers 70 and 72. The lid has a depending rear wall 146 having its lower corners pivoted on pins 148 in the side walls 42, 46. A pair of supports 150 at opposite ends of the top or cover 142 depend and rest on the opposite ends of the air distribution tube 80 to support the lid or cover in its closed position as shown in FIGS. 1 and 2. When access is desired to drying space, as for cleaning or repairs, the cover is pivoted up into the rear about the pins 148.

Peripherally grooved idler rollers 152 and 154 are respectively journaled on the air distribution tubes 78 and 80 in axially spaced relation. Sets of rubber O-rings 156 are slightly stretched over the idler rollers 152 and over the shaft 98, while similar sets of O-rings 158 are mounted over the idler rollers 154 and the shaft 100. As will be seen particularly in FIG. 3 the O-rings 158 (and similarly, the O-rings 156) engage the left faces of the guide rollers 92 and right faces of the guide rollers 100, whereby the O-rings are positively positioned axially. The O-rings 156 are driven by rotation of the shaft 98, while the O-rings 158 are drived by rotation of the shaft 100, respective grooved idler rollers or pulleys 152 and 154 readily turning on the respective air distribution tubes 78 and 80. As will be apparent, the O-rings preclude rolling up of the film about any of the rollers. The O-rings are cheap and easily obtained in commerce for initial manufacture. Being made of chemically resistant rubber, such as neoprene, they will last almost indefinitely in use. However, should one break, it is not necessarily to make a complete disassembly of the machine. It is only necessary to move the respective shafts and tubes from one wall 42, 44, whereupon one or more O-rings may be stretched and slipped into position.

It will be apparent that there is a large air opening area at the entrance to the squeegee rollers 70 and 72, since the floor 48 and shelf 54 (and even the top of the drip tray 138) are spaced well below the bottom extremity of the roller 70, while the cover or lid 142 in closed position is spaced well above the upper extremity of the upper squeegee roller 72. Thus, there is free exit of air at the film entry, hence to carry moisture and high humidity air out of the machine. The rods 62 and 64, besides serving in part as entrance guides for the film serve to keep an operator's fingers away from the squeegee rollers, hence to avoid the possibility of injury to an operator.

The dryer as heretofore disclosed has proved in practice to be quite satisfactory. However, it has been found that from time to time one of the O-rings 158 will break Replacement of such an O-ring is not difficult, but it is somewhat tedious in that excessive disassembly of the dryer is required. Accordingly, I have improved the dryer by substituting an improved part for the O-ring. The improved form of the dryer is shown in FIGS. 5–9. In these figures numerals similar to those heretofore used are used with the addition of the suffix a.

Figures 5, 6, 7, 8, 9:
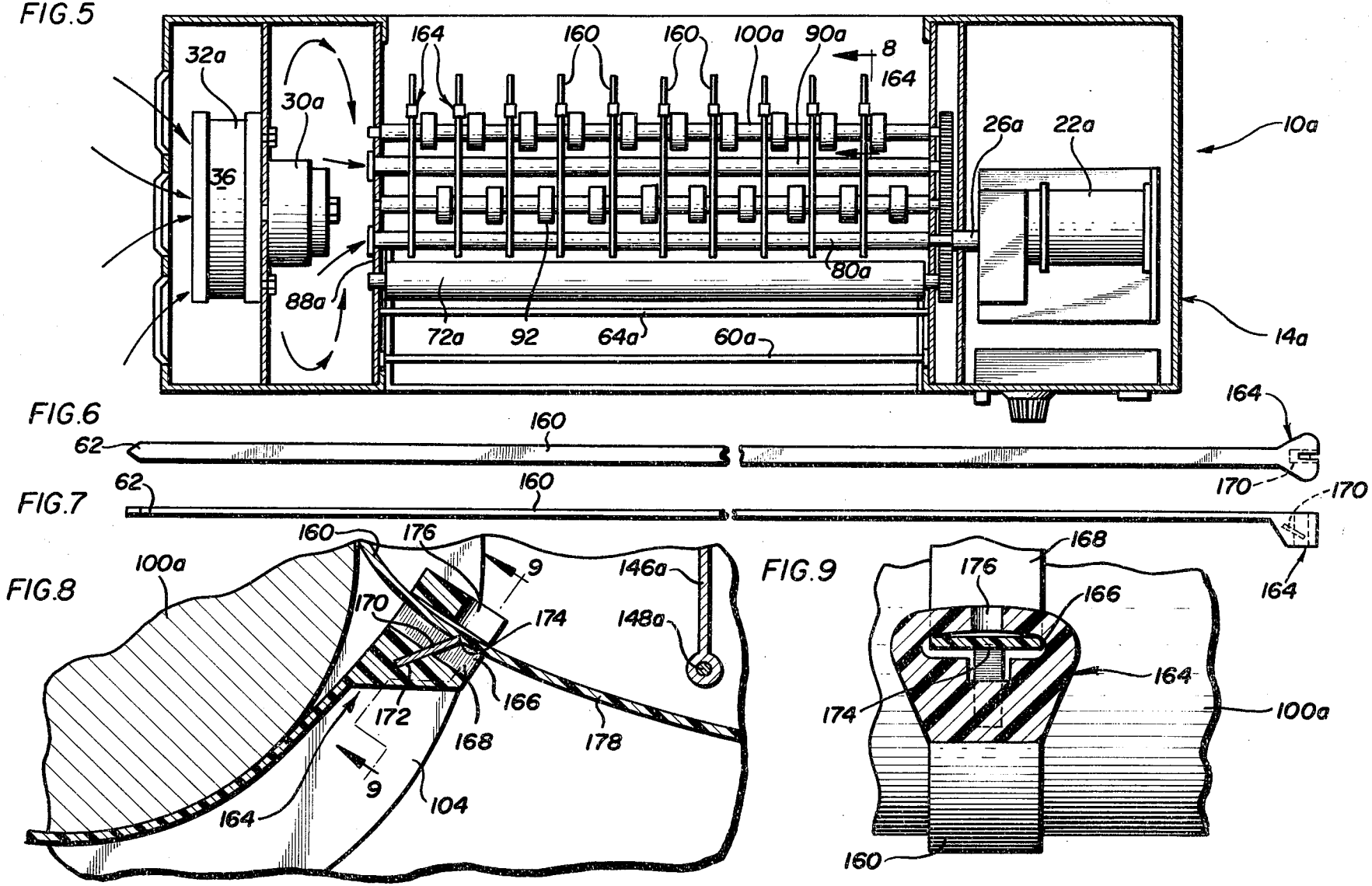
FIG. 5 is a horizontal sectional view similar to FIG. 3 showing a modification comprising a preferred embodiment of the invention.
FIG. 6 is a plan view of a flexible guide member used in the modified form of the invention conventionally used as a cable wrap.
FIG. 7 is a side view of the cable wrap of FIG. 6.
FIG. 8 is an enlarged sectional view corresponding to a portion of FIG. 3 and taken along the line 8—8 of FIG. 5
FIG. 9 is a cross section as taken along the line 9—9 in FIG. 8.

Specifically, and with reference to FIGS. 6 and 7, I employ a strip 160 made of nylon or other suitable plastic and generally known as a cable wrap. The specific cable wraps that I employ are identified as "T & B Ty-rap". This particular cable tie or wrap on its face purports to be patented, but the patent information is not known to me.

The cable tie or wrap comprises an elongated strip pointed at one end as indicated at 162, and having a head 164 at the other end. The head 164 lies essentially to one side of the plane of the strip 160, which will be seen as being of wider construction than its thickness. The head 164 has an opening 166 therethrough large enough to receive the opposite end of the strip, the pointed end 162 facilitating entrance. The opening 166 has a central trough portion 168, whereby the opening is essentially T-shaped in cross section. A metal tongue 170 extends diagonally through the trough portion 168 of the opening 166 and up into the main portion thereof at an oblique angle, the lower end of the tongue being driven into or imbedded in the lower portion of the head at 172. Accordingly, the upper edge 174 of the tongue bears up against the underside of the strip 160, the underside of the strip generally adjacent the end being ribbed or serrated on a very small scale not visible in the present drawings. However, although the serrations will aid the tongue in securing the strip in place within the opening or slot 166, they are not essential since the outer end of the tongue is relatively sharp and will bite into the plastic. Furthermore, cold flow of the plastic material will cause this to become a more secure engagement as time goes on. Finally, there is an upward opening 176 in the head communicating with the slot or opening 166. It is presumed that this is for convenience in molding, or for installing the tongue 170.

As will be apparent with reference to FIG. 5 and also to FIG. 8 the plastic cable wraps or straps 160 replace the rubber O-rings, being looped about the hollow tube **80*a* and shaft 100*a* (and also tube 78*a* and shaft 98). End portions of each strip as identified at 178 extend beyond the depending rear wall 146*a* of the lid or cover, and thereby provide further guidance for film or the like exiting from the dryer. As will be apparent in FIG. 8 the strip 160 makes only partial contact with the shaft 100*a*. This, coupled with the slippery exterior surface, the tendency for the plastic material to set in a given position, and the fixed nature of the tube 80*a* causes each cable strap to remain in installed position without moving, as in FIG. 8. It will be appreciated that the showing in FIG. 8** is of the upper portion of the machine, and that the lower portion is a mirror image thereof.

As will now be apparent, the cable wraps as used instead of the O-rings in the preferred form of the invention are very easy to install during the initial manufacture. Furthermore, in case of breakage, renewal elements can be inserted without the necessity of any dissembly whatsoever of the machine. The nylon cable ties or wraps are substantially impervious to chemical damage from any photochemistry, and have the further advantage in that the extending ends serve as exit guides for the film being dried.

It will now be apparent that the present machine requires less parts than the prior art, hence being less expensive to manufacture. Full provision is made for removal of moisture from the machine, whereby to prevent rusting or corrosion of the housing and an unduly short service life. The O-rings or cable wraps or ties serving as strippers preventing winding up of film about the rollers are relatively inexpensive, are readily procured in commerce, and are long lived, yet readily replaced if they should fail.

The specific examples of the invention as herein shown and described is for illustrative purposes only. Changes in structure will no doubt occur to those skilled in the art, and will be understood as forming a part of the invention insofar as they fall within the spirit and scope of the appended claims.

The invention is claimed as follows:

1. A film dryer comprising a housing having an inlet area, including a film inlet opening, at least one pair of squeegee rollers in said inlet area and aligned with said inlet opening for receiving moisture-laden film manually fed into said dryer, a top panel of said housing terminating substantially adjacent said squeegee rollers so as not to obstruct said inlet area, said squeegee rollers being positioned one above the other and in rolling engagement with one another for squeegeeing water from film and having a total vertical height substantially equal to the sum of their diameters, a removable drip tray positioned below said squeegee rollers such that a substantial proportion of the moisture on the film is squeegeed off by the rollers and drips into the drip tray, substantially preventing further moisture from dripping interiorly of said inlet area, said housing having a film outlet opening and air distributing means disposed between said inlet opening and said outlet opening for distributing air within said housing and out through said inlet opening to dry any residual moisture from said film and carry said residual moisture in the direction of said inlet opening to exit said dryer therethrough, said inlet opening having a vertical dimension greater than the vertical height of said squeegee rollers and a horizontal dimension substantially similar to the width of said squeegee rollers to assure said exit of substantially all of said residual moisture therethrough and wherein said air distributing means comprises pairs of air distributing tubes extending from side to side of said housing and having air exit jets directed generally toward the plane of the film passing between said film conveyor rollers and angled back toward said inlet opening to carry moisture toward and out of said inlet opening.

2. A film dryer as set forth in claim 1 and further including shafts carrying film conveyor rollers and disposed inwardly of said housing from said squeegee rollers for guiding the film from the squeegee rollers to the film outlet in a substantially horizontal plane through the air distributing means, said film conveyor rollers being of soft material for guiding the film without squeegeeing any additional moisture from the film, and resilient belt means surrounding said conveyor roller carrying shafts and extending generally from adjacent said squeegee rollers past said conveyor rollers to strip film from all of said conveyor rollers so as to preventing catching of the film in the conveyor rollers.

3. A film dryer as set forth in claim 2 wherein said conveyor rollers comprise pairs of spaced apart rollers of limited axial extent so as to allow substantial air to flow from said air exit jets onto the film and wherein end portions of said additional pairs of rollers engage said belt means to axially position said belt means.

4. A film dryer as set forth in claim 2 wherein said belt means comprises plastic cable ties slidably engaging said shafts, to allow rotation of the shafts with the cable ties remaining in a fixed position.

5. A film dryer as set forth in claim 4 wherein the cable ties have ends extending therefrom towards said outlet opening for further guidance of a film dried in said dryer.

* * * * *